US008079767B2

(12) United States Patent
Rolion et al.

(10) Patent No.: US 8,079,767 B2
(45) Date of Patent: Dec. 20, 2011

(54) FIXED-NIB WRITING INSTRUMENT WITH A PROTECTIVE RETRACTABLE SLEEVE

(75) Inventors: Franck Rolion, Asnières sur Oise (FR); Arnaud Bez, Garches (FR)

(73) Assignee: Socite BIC, Clichy (FR)

( * ) Notice: Subject to any disclaimer, the term of this patent is extended or adjusted under 35 U.S.C. 154(b) by 213 days.

(21) Appl. No.: 12/444,550

(22) PCT Filed: Oct. 2, 2007

(86) PCT No.: PCT/FR2007/052062

§ 371 (c)(1), (2), (4) Date: Jun. 19, 2009

(87) PCT Pub. No.: WO2008/040912

PCT Pub. Date: Apr. 10, 2008

(65) Prior Publication Data

US 2010/0074670 A1 Mar. 25, 2010

(30) Foreign Application Priority Data

Oct. 6, 2006 (FR) ..... 06 08808

(51) Int. Cl.
*B43K 24/02* (2006.01)

(52) U.S. Cl. ..... 401/107; 401/116; 401/117

(58) Field of Classification Search ..... 401/99, 401/102, 107, 108, 112, 116, 117
See application file for complete search history.

(56) References Cited

U.S. PATENT DOCUMENTS

| | | | | |
|---|---|---|---|---|
| 2,952,242 | A * | 9/1960 | Rosso | 401/108 |
| 4,529,328 | A | 7/1985 | Wacha et al. | |
| 4,780,016 | A | 10/1988 | Kim | |
| 2001/0053307 | A1 | 12/2001 | Rigoni | |
| 2007/0172301 | A1 | 7/2007 | Rolion et al. | |

FOREIGN PATENT DOCUMENTS

| | | |
|---|---|---|
| DE | 4431741 | 2/1996 |
| DE | 20009728 | 9/2000 |

* cited by examiner

*Primary Examiner* — Tuan Nguyen
(74) *Attorney, Agent, or Firm* — Jones Day

(57) ABSTRACT

A fixed-nib writing instrument having a shaft extending along a longitudinal axis (A) and at the front of which a protective sleeve is mounted such that it can move coaxially with respect to the shaft, the sleeve moving between a protecting position in which it covers the writing nib and a retracted position in which it enables writing, the sleeve having a wall section which includes at least one helical guide path in engagement with at least one peg connected to the shaft in order that a rotation of the sleeve causes the latter to slide translationally between the protecting position and the retracted position.

10 Claims, 2 Drawing Sheets

FIXED-NIB WRITING INSTRUMENT WITH A PROTECTIVE RETRACTABLE SLEEVE

This application is a national stage application of International Application No. PCT/FR2007/052062, filed on Oct. 2, 2007, which claims the benefit of French Patent Application No. 06 08808 filed on Oct. 6, 2006, the entire contents of both applications being incorporated herein by reference.

BACKGROUND OF THE PRESENT INVENTION

Field of the Invention

The embodiments of the present invention relate to fixed-nib writing instruments having a shaft extending along a longitudinal axis and at the front of which a protective sleeve having an exterior surface and an interior surface is mounted such that it can move coaxially with respect to the shaft, having its interior surface designed to slide along the exterior surface of a front part of the shaft, the sleeve moving between a protecting position in which it covers the writing nib and a retracted position in which it enables writing, the sleeve comprising a wall section which includes at least one helical guide path in engagement with at least one peg connected to the shaft in order that a rotation of the sleeve causes the latter to slide translationally between the protecting position and the retracted position.

Such a writing instrument is known from the U.S. Pat. No. 4,780,016 and has various drawbacks. In particular, it is necessary for the protective sleeve to be relatively deformable in order for its circular cross section to become oval during mounting so that two beveled rigid pegs formed on the shaft are able to pass through and are able to be inserted into guide slots in the sleeve.

Also known is the patent application FR2809671A1 which describes a writing instrument including a shaft and a tubular element mounted such that it can slide translationally at the front of the shaft, a rear-end part of this tubular element including two pegs formed on resiliently retractable lugs, each peg engaging with a profiled slot forming a cam path in the wall of the shaft such that the tubular element is able to slide relative to the shaft between two positions where the writing nib is either extended or retracted. Conventionally, each cam path has two end sections each forming a bearing which corresponds to an extended or retracted position of the nib, such that a peg pressing on the bearing in the axial direction does not cause the tubular element to rotate. However, both in the extended and the retracted position of the nib, the tubular element risks being subjected to an accidental rotational force which, even if relatively weak, could result in the peg disengaging from the bearing, which could cause an unintentional sliding of the tubular element.

It is an object of an embodiment of the invention to eliminate these drawbacks by providing a writing instrument in which the protective sleeve is prevented from sliding on the shaft in the extended position and in the retracted position of the writing nib by a certain locking.

To this end, a subject of an embodiment of the invention is a writing instrument as described in the preamble, wherein the at least one peg is designed to be resiliently retractable in order that it can snap into the helical guide path with which it engages, and in that means for holding the rotation of the sleeve are provided to prevent the sleeve from rotating below a certain force threshold in the protecting position and the retracted position, the holding means comprising at least one longitudinal rib designed to be inserted resiliently in a first groove and in a second groove in the protecting position and the retracted position, respectively.

Advantageously, the sleeve is fitted around a front part of the shaft in order to slide along the latter, and a front section of the front part of the shaft comprises at least one first groove and at least one second groove extending longitudinally and each running out at a front-end annular rim of the front section, a through-slot extending through the wall of the front section between the rear end of the first groove and the rear end of the second groove in order to create a region of flexibility between the first groove and the second groove.

Advantageously, the protective sleeve has an interior surface and the means for holding the rotation of the sleeve comprise two diametrically opposed longitudinal ribs of the same length provided on the interior surface and also four grooves comprising a pair of first grooves and a pair of second grooves.

SUMMARY OF THE INVENTION

Other preferred embodiments of a fixed-nib writing instrument according to an embodiment of the invention makes use of the following arrangements, taken separately or in combination:

the front part of the shaft is preferably formed by a cylindrical tube, and the radius of the interior surface of the wall of the front part at any point between a pair of first grooves or between a pair of second grooves is greater than the inside radius of the cylindrical tube;

the angular extent of at least one helical guide path is preferably designed in such a way that the protective sleeve is preferably turned 90° in relation to the shaft between the protecting position and the retracted position, and the four grooves of the holding means are angularly distributed at intervals of 90° around the periphery of the front part of the shaft;

the two grooves of each pair of first or second grooves have a difference in length preferably equal to the travel of the protective sleeve between the protecting position and the retracted position of the sleeve;

besides its front part, the shaft preferably includes an annular intermediate part having substantially the same outside diameter as the wall section of the protective sleeve and preferably comprises a substantially cylindrical-tubular rear part;

the protective sleeve preferably comprises a substantially cylindrical-tubular rear part with a rear-end rim which has undulations in the longitudinal direction, and the intermediate part of the shaft comprises a front-end rim which has similar undulations such that the end rims are separated from one another by a small clearance around their entire circumference in the retracted position of the sleeve;

one region of flexibility of the front section of the front part of the shaft is substantially aligned with one peg and with an undulation trough in the front-end rim of the intermediate part of the shaft along a straight line parallel to the axis of the instrument; and the undulations of each of the end rims, the one at the rear of the sleeve and the other at the front of the intermediate part of the shaft preferably have two crests and two troughs which are diametrically opposed, and the spacing between two respective troughs of the shaft and of the sleeve in the longitudinal direction is preferably greater than 5 mm.

BRIEF DESCRIPTION OF THE DRAWINGS

Further features and advantages will become apparent from the following description of non-limiting exemplary embodiments, with reference to the figures, in which.

DETAIL DESCRIPTION OF THE DRAWINGS

Figure 1:
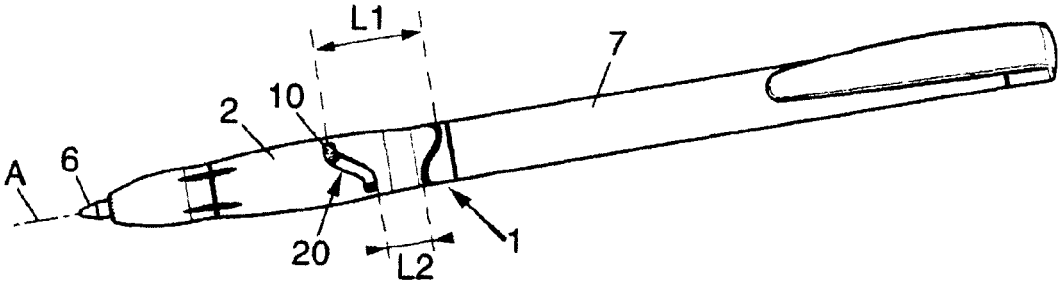
FIG. 1 shows a complete view of a writing instrument according to an embodiment of the invention, with the protective sleeve in the retracted position enabling writing.
Figure 5:
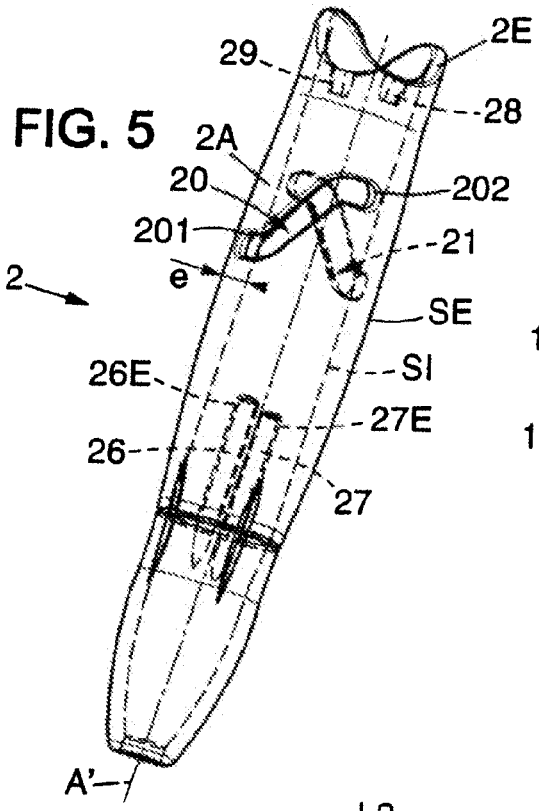
FIG. 5 shows a wireframe perspective view of the protective sleeve.

The writing instrument shown in FIG. 1 in the writing position, that is to say the retracted position of the protective sleeve, has a shaft 1 which extends along a longitudinal axis A. A second shaft 7 is force-fitted onto the rear part of the shaft 1 in order to be secured thereto and to form a complete shaft which extends along essentially the whole length of the instrument. It goes without saying that these two components could alternatively be molded together as a single shaft. The shaft 1 can be seen in detail in FIG. 3. It comprises a substantially cylindrical-tubular front part 1A, an annular intermediate part 1B having a larger outside diameter, and a substantially cylindrical-tubular rear part 1C which in this case has the same outside diameter as the front part 1A. A protective sleeve 2, which can be seen in detail in FIG. 5, is mounted such that it can move translationally in a helical manner coaxially with respect to the shaft 1, in that its interior surface SI is designed to slide along the exterior surface of the front part 1A of the shaft. The protective sleeve 2 comprises a wall section 2A which includes two helical guide paths 20 and 21 each engaging with a peg 10 or 11 connected to the shaft 1 in order to convert a rotation of the sleeve 2 into a sliding movement between the protecting end position and the retracted end position.

Each helical guide path 20 or 21 comprises a cam surface formed by a wall of a recess provided in the thickness of the wall section 2A of the sleeve 2. Each recess is in this case formed by a through-slot. The two pegs 10 and 11 are diametrically opposed on the front part 1A of the shaft 1 and each comprises a substantially cylindrical dowel with a rounded upper edge, the respective axes of the two dowels coinciding on a single diametrical straight line D1. Each peg 10 or 11 is designed to be resiliently retractable with respect to the axis of the shaft, its retraction taking place in the direction of the diametrical straight line D1. Thus, the protective sleeve 2 is mounted around the front part 1A of the shaft 1 by snap-fastening. The feature whereby each peg is resiliently retractable serves merely for mounting the sleeve 2, or possibly demounting it with the aid of an appropriate tool.

Figure 3:
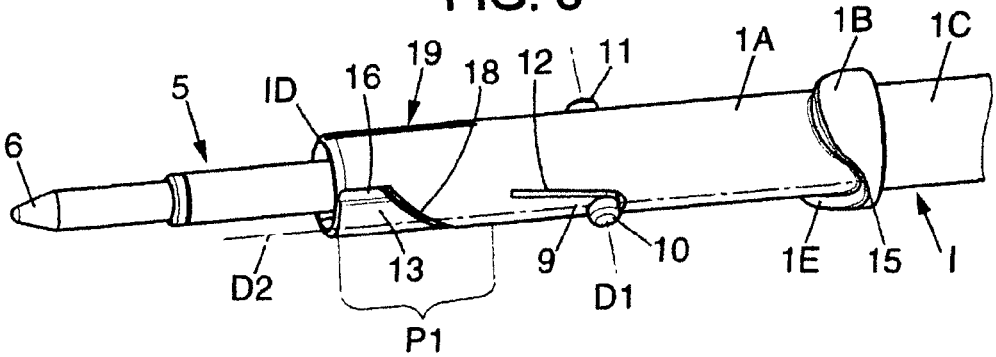
FIG. 3 shows a perspective view of the front part of the writing instrument shaft, before the protective sleeve is mounted.

A peg 10 or 11 moves relative to the shaft only in a substantially radial direction, that is to say perpendicular to the axis A of the instrument. In order to provide the property of resilient retractability in such a direction, each peg 10 or 11 is advantageously formed by a protrusion located at the free end of a flexible tab 9 formed in the wall of the shaft, as can be seen in FIG. 3. The cylindrical dowel constituting the protrusion of each tab is in this case integrated by molding it as one piece with the flexible tab and the shaft. Since each tab 9 is formed in the wall of the shaft by a through-slot 12 of appropriate form, the free end of a tab travels about a circular arc at a tangent to the axis of the associated peg, that is to say substantially along the diametrical straight line D1 passing through the two pegs.

Figure 2:
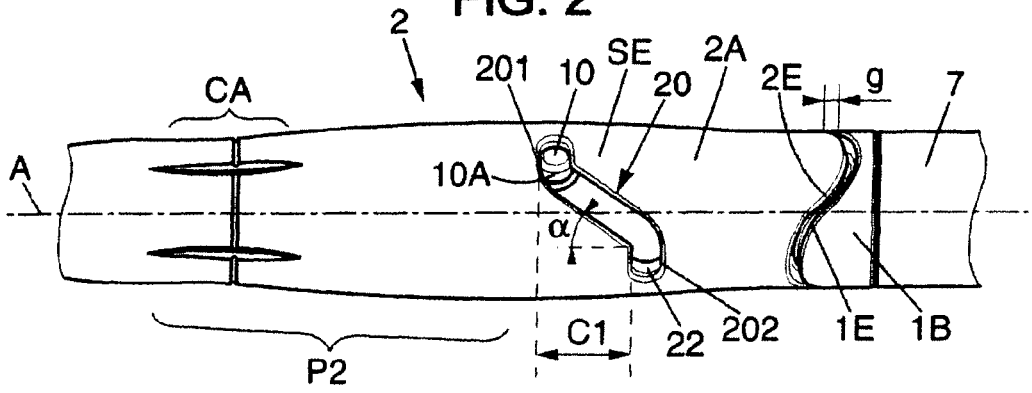
FIG. 2 shows a partial side view of the protective sleeve mounted on the shaft, in its retracted position.

In FIG. 2, the protective sleeve 2 has a grip region P2 located longitudinally in front of a wall section 2A which comprises two helical guide paths. This wall section 2A is defined as the part of the sleeve extending longitudinally between the front ends of the helical paths 20 and 21 and the rear-end rim 2E of the sleeve 2. This wall section 2A has substantially the same outside diameter as the intermediate part 1B of the shaft 1 and as the second shaft 7. In this way, the exterior surfaces of these components are located substantially in line with one another.

The rear-end rim 2E of the protective sleeve 2 has undulations in the longitudinal direction. Preferably, these undulations are shaped so as to maximize the distance L1 between the rear-end rim 2E of the sleeve and the front end of each helical guide path 20 or 21, and also to minimize the distance D2 between the rear-end rim 2E and the rear end of each helical guide path. The front end 201 of the guide slot 20 is thus located in the same angular position as an undulation crest of the sleeve 2. In addition, the rear end 202 of the slot is located in the same angular position as an undulation trough of the sleeve. In the embodiment shown, the angular extent of each helical guide path is equal to 90°, that is to say it is designed such that the sleeve 2 is preferably turned 90° in relation to the shaft between the two end positions of the sleeve.

It is preferable for the angular extent of each guide slot to be less than 120°, and even more preferably less than 100°, in order not to compromise the rigidity of the wall section 2A which includes the helical guide paths. It is also preferable for the angle $\alpha$ formed by a guide path with respect to the longitudinal axis A to be between 30° and 50°: this arrangement requires relatively little effort in order to convert the rotation of the sleeve into a sliding movement in the direction of the axis A, while enabling a sufficient longitudinal extent of the guide path to permit sufficient travel C1 for the translation of the protective sleeve between its two end positions.

Each peg 10 or 11 has a peripheral surface with a main part 10A or 11A, each point of which can be in contact with the wall of a guide slot 20 or 21. The main part 10A of the peg 10 that can be seen in FIG. 2 thus has a predetermined contact height h with the wall 22 of the recess constituting the guide slot 20. Preferably, this contact height h is always greater than or equal to half the thickness e of the wall section 2A of the sleeve. In the embodiment shown, this contact height h is around three-quarters of the thickness e of the wall of the sleeve through which wall the slot passes.

As an alternative to through-slots, it is conceivable to provide for the wall section 2A which comprises the two helical guide paths to have no lateral opening at all, by providing that during manufacture in the mold, each recess that forms a guide path does not pass right through and therefore opens only toward the inside of the sleeve. A narrow wall would therefore remain that would conceal each recess and would continue the exterior surface of the wall section 2A; the thickness of this narrow wall would typically be between a quarter and half the thickness e of the wall section 2A. This kind of production would have the advantage of avoiding the risk of dirt being introduced into the guide slot, which dirt could eventually lead to the guiding mechanism of the sleeve no longer working properly. On the other hand, the sleeve would a priori be more complex to mold.

Moreover, in order to avoid any risk of dirt being introduced into the interior space of the through-slots, it is conceivable to fit an elastomeric grip which would cover the grip region P2 and the guide slots 20 and 21.

Advantageously, the intermediate part 1B of the shaft 1 comprises an end rim 1E which has undulations similar to those of the rear-end rim 2E of the sleeve, such that these two end rims 1E and 2E are separated from one another by a small clearance g around their entire circumference in the retracted position of the sleeve, as can be seen in FIG. 2.

Figure 4:
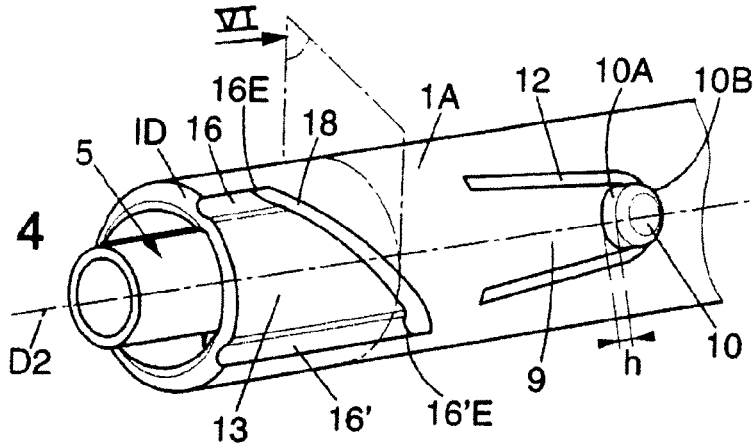
FIG. 4 shows a partial perspective view of the front part of the writing instrument shaft.
Figure 6:
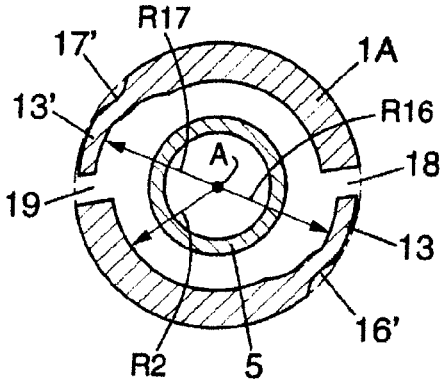
FIG. 6 shows a cross-sectional view through the front part of the writing instrument on the section plane VI shown in FIG. 4.

A front section P1 of the front part 1A of the shaft comprises on its exterior surface four grooves which extend longitudinally and each run out at an annular rim 1D at the front end of this section P1. In FIGS. 3 and 4 only one pair of first grooves 16 and 16' can be seen, these two first grooves being angularly spaced apart by 90°. The two second grooves 17 and 17' of a second pair are also spaced apart by 90°. The difference in length between the two grooves of each pair is equal to the travel C1 of the protective sleeve 2 between the protecting end position and the retracted end position. Two grooves of the same length as each other are diametrically opposed, as can be seen in FIG. 6 for the grooves 16' and 17'.

The two pairs of grooves are part of the means for holding the rotation of the protective sleeve 2, in each of the two end positions, in order to prevent the sleeve from rotating below a certain force threshold. Each pair of grooves is in engagement with a rib of the sleeve 2, two diametrically opposed longitudinal ribs 26 and 27 of the same length as each other being provided for this purpose on the interior surface SI of the sleeve 2, as can be seen in FIG. 5. In each end position of the sleeve, each rib 26 or 27 is inserted respectively into one of the two first grooves 16 and 16' or one of the two second grooves 17 and 17' in order to form a holding notch to prevent the sleeve from rotating below a certain force threshold.

The holding notch thus formed necessarily has a certain radial resilience in order that when the force threshold is exceeded, a rib can emerge from one of its two associated grooves in order to be moved toward the other groove without there being excessive contact pressure between this rib and the exterior surface of the front section P1 which includes the grooves. To this end, this front section P1 comprises two regions 13 and 13' of flexibility, one between a pair of first grooves 16 and 16' and the other between a pair of second grooves 17 and 17'. These two regions 13 and 13' of flexibility are each bounded in the longitudinal direction, by first and second through-slots 18 and 19, respectively.

The two slots 18 and 19 each extend in the wall of the front section P1 between the rear ends 16E and 16'E, respectively, of the first grooves 16 and 16' that can be seen in FIG. 4 and between the rear ends (not shown) of the second grooves 17 and 17', respectively. Thus, a region 13 or 13' of flexibility is connected to the rest of the front section P1 only by two thinner strips of wall that are located one beneath each of the two grooves that bound this region. The feature of the two slots 18 and 19 thus provides per se a certain radial flexibility for each of the two regions 13 and 13'.

In order to further improve the radial flexibility of each region 13 or 13', the wall thickness is reduced locally with respect to the wall thickness of the cylindrical tube which forms overall the front part 1A of the shaft. To this end, as can be seen in the sectional view shown in FIG. 6, the radius R16 or R17 of the interior surface of the wall of a region 13 or 13' of flexibility, that is to say the radius at any point between a pair of first grooves 16 and 16' or between a pair of second grooves 17 and 17', is greater than the inside radius R2 of the cylindrical tube that forms the front part 1A of the shaft.

Each rib 26 or 27 is positioned in the sleeve 2 such that, in each end position of the sleeve, the engagement of a rib in a groove occupies the entire length of the groove. For example, the rear end 26E of the rib 26 will coincide with the rear end 16'E of the groove 16' in the retracted position of the sleeve, and with the rear end 16E of the groove 16 in the protecting position of the sleeve.

Advantageously, a region 13 or 13' of flexibility is substantially aligned with a peg 10 or 11 and with an undulation trough 15 of the front-end rim 1E of the intermediate part 1B of the shaft 1 along a straight line D2 parallel to the axis A of the writing instrument. As can be seen in FIG. 4, the straight line D2 passes substantially through the middle of the region 13 of flexibility, that is to say equidistant from the two first grooves 16 and 16'. With such an alignment, the coaxial hold of the sleeve 2 on the shaft 1 in the mid-plane PI-II (not shown) formed by the two straight lines D1 and D2 (see FIG. 3) is reinforced at the rear of the sleeve, since the longitudinal contact length between the interior surface of the sleeve and the exterior surface of the front part 1A of the shaft is at a maximum in the mid-plane.

Because of its flexibility, a region 13 or 13' is unable to effectively contribute to the coaxial hold between the sleeve and the shaft. Extending the total contact length in the mid-plane PI-II, as can be seen along the straight line D2, makes it possible to compensate for the loss of "effective" contact length caused by the presence of a region 13 or 13' of flexibility.

In FIG. 5, it can be seen that the sleeve 2 has axial symmetry with respect to its longitudinal axis A'. It is notable that two diametrically opposed beveled recesses 28 and 29 are provided on the interior surface SI of the sleeve, each with a surface inclined in the longitudinal direction and opening out at the rear of the sleeve at the rear-end rim 2E. This feature makes it possible to simplify the positioning of the sleeve 2 on the front part 1A of the shaft during mounting, since each recess is designed to help guide one of the two resiliently retractable pegs 10 and 11 and thus to guide the insertion of the sleeve on the shaft. The inclined surface of each recess 28 or 29 allows a progressive resilient retraction of the associated peg 10 or 11 when the sleeve 2 is pushed toward the shaft 1 during mounting.

In order to make it easier to slide each peg against the interior surface of the sleeve 2 during mounting, an upper part 10B of the peripheral surface of a peg 10, such as can be seen in FIG. 4, is formed by a rounding designed to slide on the interior surface of the sleeve 2. Such a rounding is not necessarily in contact with the guide path associated with the peg once the mounting is complete. Advantageously, each recess 28 or 29 is located in the same angular position as a rear end of a helical guide path 20 or 21.

FIG. 6 shows a cross-sectional view on the section plane VI shown in FIG. 4, and has been discussed previously in relation to FIG. 4.

Figure 7:
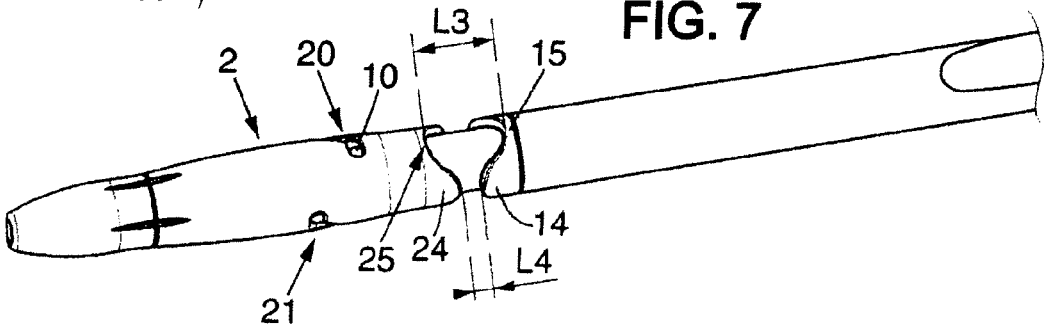
FIG. 7 shows a perspective side view of the writing instrument in the protecting position of the sleeve.

In FIG. 7, with the sleeve 2 in its protecting position, it can be seen that the spacing L3 between two troughs 15 and 25, of the shaft and of the sleeve respectively, in the longitudinal direction is much greater than the spacing L4 between two crests 14 and 24, of the shaft and of the sleeve respectively. Besides the advantages of these troughs and crests in terms of ease of mounting and coaxial hold of the sleeve, this arrangement makes it easier for the user to "cleanly" recognize by touch the protecting or writing position, that is to say without looking at the instrument and without needing to touch the front end of the instrument and risking staining a finger. This is because the spacing L3 is typically greater than 5 mm in length and the user can easily sense with a finger the indentation due to the difference in diameter of the body of the instrument locally between the two troughs 15 and 25.

The invention claimed is:

1. A fixed-nib writing instrument having a shaft extending along a longitudinal axis and at the front of which a protective sleeve is mounted such that it can move coaxially with respect to the shaft, the sleeve moving between a protecting position in which it covers the writing nib and a retracted position in which it enables writing, the sleeve comprising a wall section which includes at least one helical guide path in engagement with at least one peg connected to the shaft in order that a rotation of the sleeve causes the latter to slide translationally between the protecting position and the retracted position, wherein the at least one peg is designed to be resiliently retractable in order that it can snap into the helical guide path with which it engages, and wherein means for holding the rotation of the sleeve are provided to prevent the sleeve from rotating below a certain force threshold in the protecting position and the retracted position, the holding means comprising at least one protruding element designed to be inserted resiliently in a first groove and in a second groove in the protecting position and the retracted position, respectively.

2. The writing instrument according to claim 1, wherein the sleeve is fitted around a front part (1A) of the shaft in order to slide along the latter, and in which a front section of the front part of the shaft comprises at least one first groove and at least one second groove extending longitudinally and each groove running out at a front-end annular rim of the front section, a through-slot extending through the wall of the front section between the rear end of the first groove and the rear end of the second groove in order to create a region of flexibility between the first groove and the second groove.

3. The writing instrument according to claim 2, wherein the protective sleeve has an interior surface (SI) and the means for holding the rotation of the sleeve comprise two diametrically opposed longitudinal ribs of the same length provided on the interior surface (SI) and also four grooves consisting of a pair of the first grooves and a pair of the second grooves.

4. The writing instrument according to claim 3, wherein the front part of the shaft is formed overall by a cylindrical tube, and in which the radius of the interior surface of the wall of the front part at any point between a pair of first grooves or between a pair of second grooves is greater than the inside radius of the cylindrical tube.

5. The writing instrument according to claim 4, wherein the angular extent of the at least one helical guide path is designed in such a way that the protective sleeve is turned through 90° in relation to the shaft between the protecting position and the retracted position, and in which the four grooves of the holding means are angularly distributed at intervals of 90° around the periphery of the front part of the shaft.

6. The writing instrument according to claim 5, in which the two grooves of each pair of first or second grooves have a difference in length equal to the travel (c) of the protective sleeve between the protecting position and the retracted position.

7. The writing instrument according to claim 6, wherein, besides its front part, the shaft comprises an annular intermediate part having substantially the same outside diameter as the wall section of the protective sleeve and comprises a substantially cylindrical-tubular rear part.

8. The writing instrument according to claim 7, wherein the protective sleeve comprises a substantially cylindrical-tubular rear part with a rear-end rim which has undulations in the longitudinal direction, and in which the intermediate part of the shaft comprises a front-end rim which has similar undulations such that the end rims are separated from one another by a small clearance around their entire circumference in the retracted position of the protective sleeve.

9. The writing instrument according to claim 8, wherein the region of flexibility of the front section of the front part of the shaft is substantially aligned with the peg and with an undulation trough in the front-end rim of the intermediate part of the shaft along a straight line parallel to the axis A of the instrument.

10. The writing instrument according to claim 9, wherein the undulations of each of the end rims have two crests and two troughs which are diametrically opposed, and in which the spacing between two respective troughs of the shaft and of the protective sleeve in the longitudinal direction is greater than 5 mm.

* * * * *